US006122387A

United States Patent [19]

Borchers et al.

[11] Patent Number: 6,122,387

[45] Date of Patent: Sep. 19, 2000

[54] PIEZOELECTRIC LOUDSPEAKER

[75] Inventors: Ingo Borchers, Uhldingen-Muehlhofen; Kerstin Burckas, Karlsruhe; Klaus Renger, Uhldingen-Muehlhofen; Engelbert Kusch, Salem, all of Germany

[73] Assignee: Dornier GmbH, Friedrichshafen, Germany

[21] Appl. No.: 09/048,118

[22] Filed: Mar. 26, 1998

[30] Foreign Application Priority Data

Mar. 26, 1997 [DE] Germany ..... 197 12 728

[51] Int. Cl.[7] ..... H04R 25/00

[52] U.S. Cl. ..... 381/190; 381/114; 381/173; 310/324

[58] Field of Search ..... 381/114, 173, 381/190, 191; 310/324, 800, 321, 322, 323

[56] References Cited

U.S. PATENT DOCUMENTS 4,580,252 4/1986 Mallet .
4,978,880 12/1990 Causse et al. ..... 310/324
4,990,816 2/1991 Causse et al. ..... 310/324
5,652,801 7/1997 Paddock ..... 381/190

FOREIGN PATENT DOCUMENTS 1 261 176 of 1963 Germany .
64-36195 of 1964 Japan .

OTHER PUBLICATIONS

Brock Haus "Haturwissenschaften und Technik" Dritter Band IO–NG, p., 159.

*Primary Examiner*—Curtis A. Kuntz
*Assistant Examiner*—Suhan Ni
*Attorney, Agent, or Firm*—Evenson, McKeown, Edwards & Lenahan, P.L.L.C.

[57] ABSTRACT

A piezoelectric loudspeaker has a membrane and at least two flexural piezoresonators, one end of which is fixed, while the other end acts mechanically upon the membrane. The membrane is a flat membrane or a conical membrane having an aperture angle smaller than 10°.

7 Claims, 1 Drawing Sheet

PIEZOELECTRIC LOUDSPEAKER

BACKGROUND AND SUMMARY OF THE INVENTION

This application claims the priority of German patent document 197 12 728.2, filed Mar. 26, 1997, the disclosure of which is expressly incorporated by reference herein.

The invention relates to a piezoelectric loudspeaker having a membrane and a flexural piezo resonator.

In conventional piezoelectric loudspeakers, an individual flexural piezoresonator is securely mounted on one end, and its free end acts on a cardboard membrane, deflecting it. A flexural resonator of this type is described, for example, in Brockhaus, "Natural Science and Technology", Mannheim, Special Edition, 1989, Volume 3, Page 159. Since, in this case, partial vibrations and deformations of the membrane are undesirable, the membrane must be as stiff as possible. For this purpose normally a steep conical shape is selected, which requires a large height, considerably restricting the possibility of placement, for example, in an automobile.

It is therefore an object of the invention to provide a piezoelectric loudspeaker having an extremely low height.

This and other objects and advantages are achieved by the loudspeaker according to the invention, in which several flexural piezoresonators that are used as the drive are fixed on one end, and can be constructed to be extremely flat. The free end of these elements act upon a flat membrane or a conical membrane, the cone having a very flat construction (base angle less than 10°). The position of the individual flexural piezoresonators with respect to the membrane can be freely selected.

By means of the construction according to the invention, heights can be achieved which are lower than approximately 10 mm. Despite this flat construction, the generation of partial vibrations of the membrane can be avoided.

It is another advantage of the invention that the individual flexural piezoresonators can be operated with different phase positions relative to one another, thereby considerably improving the frequency response of the loudspeaker.

Since the natural frequency of the flexural piezoresonator depends on its free length, breaks in the frequency response can be compensated by adjusting different free bending lengths for the individual flexural piezoresonators. A combination of flexural piezoresonators with different free lengths causes these natural frequencies to occur over a wide frequency range. Thus, skillful adaptation provides a simple possibility for tuning the frequency response of the loudspeaker.

In a particularly advantageous embodiment, a flexural piezoresonator consists of several cascaded flexural piezoresonators. As a result, the stroke or the force exercised on the membrane can be increased.

Advantageously, a carbon fibre kevlar (CFK) sandwich membrane with a kevlar insert between the sandwich core and the cover layer is used as the membrane. This CFK sandwich membrane may be constructed as a flat membrane as well as a flat cone, and has the advantage of a very high stiffness.

Other objects, advantages and novel features of the present invention will become apparent from the following detailed description of the invention when considered in conjunction with the accompanying drawings.

DETAILED DESCRIPTION OF THE DRAWINGS

Figure 1B:
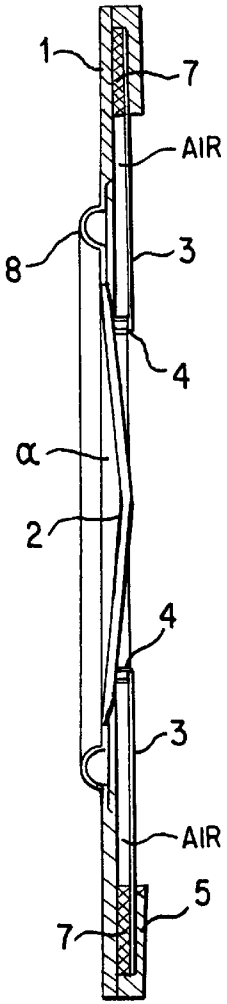
FIGS. 1*a* and 1*b* are, respectively, a top view and a sectional view along Line AA (top), of a loudspeaker according to the invention.
Figure 1A:
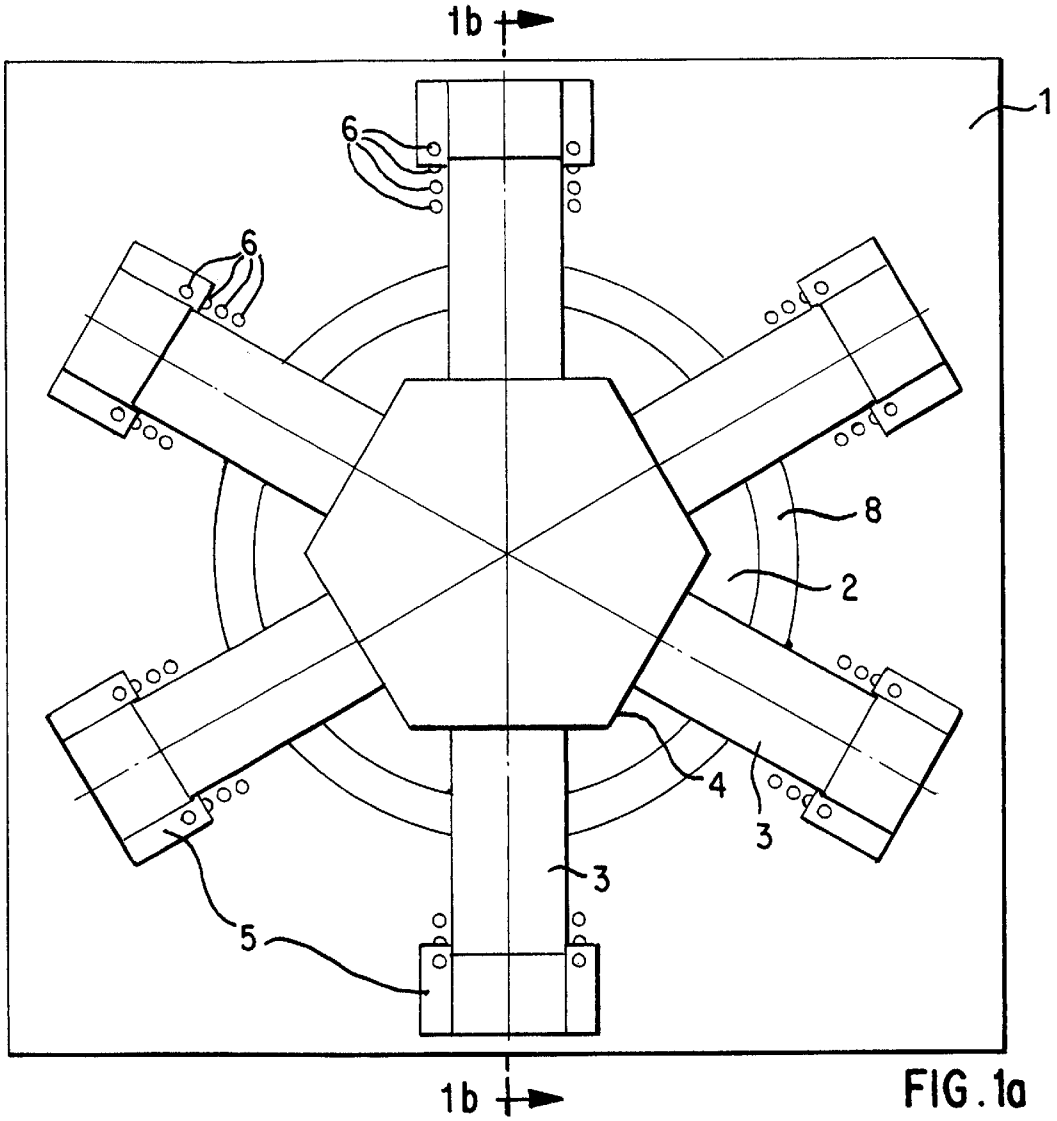

As shown in FIGS. 1*a* and 1*b*, the rectangular flexural piezoresonators 3 are fastened on one end by means of clamping blocks 5 on an aluminum base plate 1. In the illustrated embodiment, there are six flexural resonators 3 which are evenly distributed about the circumference of the round membrane 2. In this case, a flexural resonator comprises two layers which are glued to one another. These layers are controlled in an opposite-phase manner, whereby one layer is expanded and the other is shortened, generating bending forces. In order to avoid damage to the sensitive flexural resonators, mounting pieces of teflon 7 are used. By clamping the clamping blocks 5 to different ones of the bores 6, different free bending lengths can be adjusted. (In this case, the clamping corresponds to that of a cantilever beam.) When a voltage is applied to the flexural piezoresonator 3, it will bend, which deflects the membrane 2.

The membrane 2 itself is constructed as a very shallow (substantially flat) cone. The base angle a between the base surface and the generating line of the cone, is smaller than 10°. Advantageously, the membrane is a CFK sandwich construction. Since the carbon fiber fabrics used for the outer layers of the sandwich membrane are advantageously very coarsely woven, an extremely finely woven kevlar layer is also laminated in for sealing between the outer carbon fiber layer and the sandwich core. The membrane 2 constructed as the CFK sandwich structure has the advantage of a high stiffness, which is further increased by the illustrated construction as a flat cone.

The membrane 2 is fastened on the aluminum carrier plate 1 by means of a conventional bead 8. On the membrane, a CFK hexagon ring 4 is arranged which is laminated to the membrane. The CFK hexagon ring 4, in turn, is connected (for example, glued) to the free end of the individual flexural piezoresonators 3. In this case, a flexural piezoresonator is assigned to each edge of the polygon. By means of the hexagon ring, a straight connection line is achieved as a supporting surface for the flexural piezoresonators 3, thereby improving the introduction of force into the membrane. A further centering, which is customary in the case of conventional loudspeakers, is not required.

In a further embodiment of the invention (not shown), the flexural resonators may also be arranged so that they point with their free ends not radially toward the inside as in the illustrated embodiment but radially toward the outside. In this case, the clamping blocks are now arranged above or below the membrane and, as in the illustrated construction, the flexural resonators act upon the generating surface of the conical membrane.

In another advantageous construction, the individual flexural piezoresonators do not have the same construction but have different properties, for example, with respect to the stroke, the width, the thickness and the manufacturer. This arrangement facilitates manipulation of the frequency response of the loudspeaker.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A piezoelectric loudspeaker comprising:

a membrane which is one of a flat membrane and a conical membrane having an aperture angle smaller than approximately 10°; and at least first and second flexural piezoresonators, each having a first end thereof which is fixedly positioned and a second end thereof which is mechanically coupled to and acts upon the membrane, causing a translational movement thereof.

2. Piezoelectric loudspeaker according to claim 1 wherein a free clamping length of the flexural piezoresonator can be adjusted.

3. Piezoelectric loudspeaker according claim 1 wherein the membrane is a CFK-sandwich membrane with a kevlar insert between a sandwich core and a cover layer thereof.

4. Piezoelectric loudspeaker according to claim 1 further comprising a polyhedral ring arranged on the membrane and connected with the second ends of the flexural piezoresonators.

5. Piezoelectric loudspeaker according to claim 1 wherein the flexural piezoresonators can be operated individually by means of different phase positions with respect to one another.

6. Piezoelectric loudspeaker according to claim 1 wherein at least one flexural piezoresonator consists of several cascaded flexural piezoresonators.

7. Piezoelectric loudspeaker according to claim 1 wherein at least two of the flexural piezoresonators have a differing construction.

* * * * *